United States Patent [19]

Andres et al.

[11] 4,448,242

[45] May 15, 1984

[54] HEAT-EXCHANGER WITH A BUNDLE OF PARALLELLY EXTENDING PIPES ADAPTED TO BE ACTED UPON BY AIR

[75] Inventors: Rudolf Andres; Helmut Grantz, both of Sindelfingen; Wolf-Dietrich Münzel, Ehningen; Wolfgand Odebrecht, Sindelfingen, all of Fed. Rep. of Germany

[73] Assignee: Daimler-Benz Aktiengesellschaft, Stuttgart, Fed. Rep. of Germany

[21] Appl. No.: 437,202

[22] Filed: Oct. 28, 1982

[30] Foreign Application Priority Data

Oct. 31, 1981 [DE] Fed. Rep. of Germany ..... 3143333

[51] Int. Cl.[3] ..... F28D 15/00

[52] U.S. Cl. ..... 165/104.14; 165/104.21; 165/140; 165/48 R; 165/42; 29/157.3 R

[58] Field of Search ..... 165/140, 104.21, 104.26, 165/104.14, 48 R, 42; 29/157.3 R

[56] References Cited

U.S. PATENT DOCUMENTS

| | | | |
|---|---|---|---|
| 3,603,379 | 9/1971 | Leonard, Jr. | 165/104.21 |
| 3,809,154 | 5/1974 | Heller et al. | 165/104.21 |
| 4,333,520 | 6/1982 | Yanadori et al. | 165/104.21 |

*Primary Examiner*—Albert W. Davis, Jr.
*Attorney, Agent, or Firm*—Craig & Burns

[57] ABSTRACT

A heat-exchanger with a bundle of parallelly extending pipes adapted to be acted upon by air which are constructed in the manner of heat pipes; a connection box extends transversely to the pipe bundle which surrounds section-wise the heat pipe hollow spaces of the pipe bundle and which is adapted to be traversed by a heat carrier medium; the connection box essentially consists of an extruded profile whose profile direction is disposed parallel to the pipe rows of the bundle and is provided at its end faces with guide covers which take over the distribution and deflection of the heat carrier medium toward the channels inside of the extruded profile.

20 Claims, 7 Drawing Figures

HEAT-EXCHANGER WITH A BUNDLE OF PARALLELLY EXTENDING PIPES ADAPTED TO BE ACTED UPON BY AIR

The present invention relates to a heat-exchanger with a bundle of parallelly extending pipes adapted to be acted upon by air, as disclosed, for example, in the German Offenlegungsschrift No. 30 31 624. The heat-exchanger disclosed therein serves selectively for the cooling or for the heating of the passenger space of a motor vehicle. Different connection boxes are provided at the two ends of the pipe bundle, of which one can be acted upon with hot water for the heating and the other with cooling medium for the cooling. The distribution of the supplied heat, respectively, of the cooling capacity onto the air flow takes place by the pipe bundle whose pipes are constructed as conventional so-called heat pipes. Similar arrangements of a heat-exchanger adapted to be used selectively both for cooling as also for heating are disclosed in the German Offenlegungsschrift No. 27 56 119 and German Offenlegungsschrift No. 28 00 265.

It is the principal object of the present invention to indicate a type of construction of the heat-exchanger which can be manufactured in a rational manner and from which one can expect a good heat transfer between the heat carrier medium and the heat pipes.

The underlying problems are solved according to the present invention in that the connection box is formed essentially by an extruded profile whose profile direction is disposed parallel to the pipe row or rows, in that a longitudinally extending slot-like heat pipe channel is provided in the extruded profile within the area of each pipe row which is closed over the entire circumference and along the end faces thereof and which is open exclusively toward the individual pipes of the respective pipe row, in that longitudinally extending heat carrier channels open at the end faces of the extruded profile are arranged inside of the extruded profile on both sides of each heat pipe channel, and in that guide covers are sealingly secured at the two end faces of the extruded profile, into which are machined the distribution, respectively, collecting channels and/or U-shaped deflection channels which connect adjacent heat carrier channels into a uniform channel system adapted to be traversed uniformly. Owing to the use of an extruded profile with several mutually separated channels as essential component of the connection box, many mutually separated channels can be formed in a rational and price-favorable manner; on the other hand, by reason of the dense packing of many adjoining channels, an intimate heat-exchange is possible between the different flow spaces.

These and other objects, features and advantages of the present invention will become more apparent from the following description when taken in connection with the accompanying drawing which shows, for purposes of illustration only, two embodiments in accordance with the present invention, and wherein.

Figure 1:
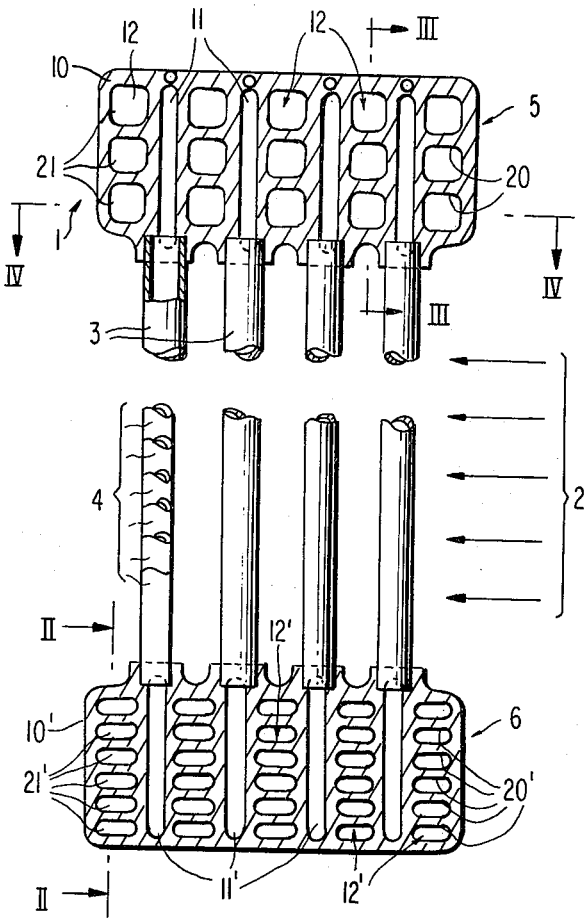
FIG. 1 is a vertical cross-sectional view through one embodiment of a heat-exchanger constructed according to the present invention parallel to the air stream.

Referring now to the drawing wherein like reference numerals are used throughout the various views to designate like parts, and more particularly to FIG. 1, the heat-exchanger generally designated therein by reference numeral 1 which is illustrated in this figure, essentially consists of an upper and of a lower connection box generally designated by reference numerals 5 and 6 as well as of a pipe bundle of parallelly extending pipes 3 connecting the two connection boxes 5 and 6 with each other and adapted to be acted upon by air; the pipe bundle, in its turn, consists of several pipe rows 4 disposed parallelly adjacent one another and of approximately equal length which are arranged transversely to the air stream 2. The pipes 3 of the pipe bundle are operatively connected with each other group-wise and form heat-pipe hollow spaces which are separated and sealed off from a flow point of view with respect to the spaces of the connection boxes adapted to be acted upon by heat carrier media. A good heat-transferring connection exists inside of the connection boxes between the flow channels of the heat carrier medium, on the one hand, and the heat-pipe hollow spaces of the pipe bundle, on the other. The heat pipes distribute at low temperature gradients the absorbed heat over the entire cross section of the air stream 2.

In the illustrated embodiment—as mentioned—two connection boxes 5 and 6 are provided at the heat-exchanger, of which the upper connection box 5 is adapted to be acted upon during cooling of the air stream with a cooling medium to be evaporated whereas the lower connection box 6 is utilized during heating and is then traversed by hot water. The heat-pipe hollow spaces of the pipe bundle, respectively, of the pipe rows 4 extend both into the upper as also into the lower connection box. During heating, the medium present in the heat-pipe hollow spaces is evaporated in the lower regions, rises in the pipes 3, gives off the heat to the air stream 2 by way of the pipe walls and condenses on the inside of the pipes; the condensate runs back by gravitational influence and/or by capillary action of a corresponding structure of the inside of the pipe to the heated place so that the circulation closes. During the cooling of the air stream, the hot water supply, of course, is turned off and in lieu thereof, cooling medium to be evaporated is conducted through the upper connection box 5. During this type of operation, the medium present in the heat-pipe hollow spaces is evaporated in the pipes 3 of the bundle exposed to the air stream, whereby heat is removed from the air. The evaporated medium rises on the inside of the pipes and condenses in the sections of the heat pipe hollow spaces disposed in the upper connection box 5 whereby the absorbed heat is transferred onto the cooling medium and the latter evaporates. The formed condensate runs back by gravitational force influence and/or by capillary action on the inside of the pipes in the downward direction into the part of the heat pipe hollow spaces which are exposed to the air stream 2, as a result of which the circulation also closes again. In every case, the condensation portion of the heat-pipe hollow space is arranged above the evaporation portion in the direction of gravity so that a condensate return flow by gravitational influence is favored. This has a favorable influence on a powerful efficient heat transfer.

The connection boxes 5 and 6 are formed essentially of an extruded profile 10, respectively, 10' from a suitable metal alloy, especially of aluminum, and provided with several different longitudinal channels, and of guide covers 13 and 13' (for the upper connection box 5) and of guide covers 14 and 14' for the lower connection box 6. The profile direction of the extruded profile is disposed parallel to the pipe rows 4. A longitudinally extending slot-like heat pipe channel 11 and 11' is arranged in the extruded profile within the area of each pipe row 4, which is closed off over the entire circumference and at the end faces; the heat pipe channel 11, respectively, 11' is open only with respect to the individual pipes 3 of the corresponding pipe row 4. Longitudinally extending heat carrier channels generally designated by reference numeral 12 and 12' are arranged on both sides of each heat pipe channel 11 and 11' inside of the extruded profile. The heat carrier channels 12 and 12' are open at the end faces of the extruded profile and pass over into corresponding deflection channels inside of the guide covers. The heat carrier media are adapted to flow through the heat carrier channels 12 and 12'. The guide covers are sealingly secured to the end faces of the extruded profile, for example, by a furnace brazing. The guide covers contain U-shaped deflection channels which connect with each other adjacent heat carrier channels into a uniform channel system extending meander-shaped through the connection box. In addition to these deflection channels, the guide covers further contain also distribution, respectively, collection spaces in which terminate the corresponding connection lines.

Figure 2:
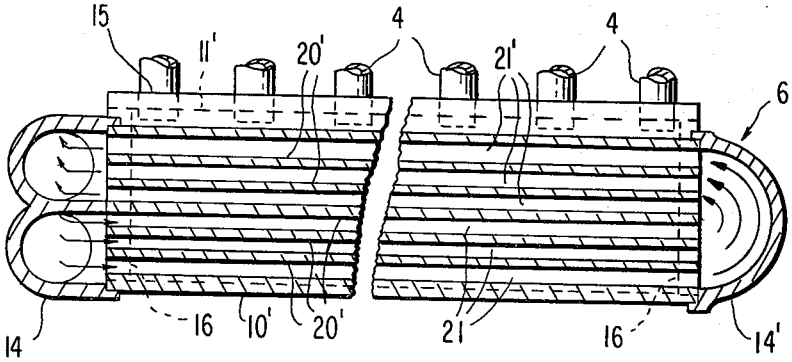
FIG. 2 is a cross-sectional view through the lower connection box of the heat-exchanger according to FIG. 1, taken along line II—II thereof.
Figure 3:
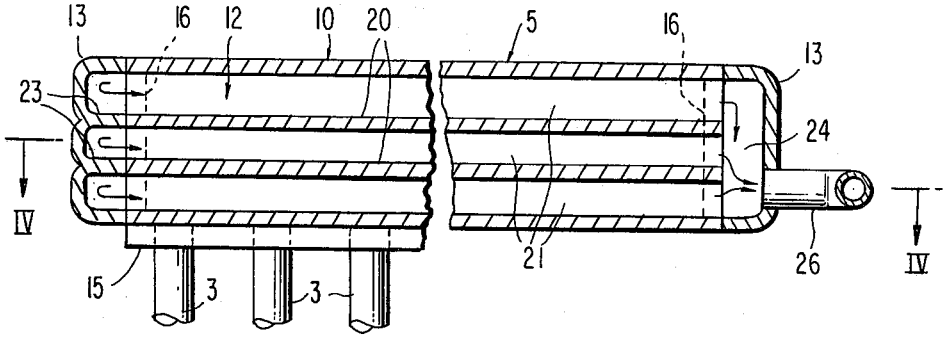
FIG. 3 is a cross-sectional view through the upper connection box of the heat-exchanger according to FIG. 1, taken along line III—III of FIG. 1.
Figure 4:
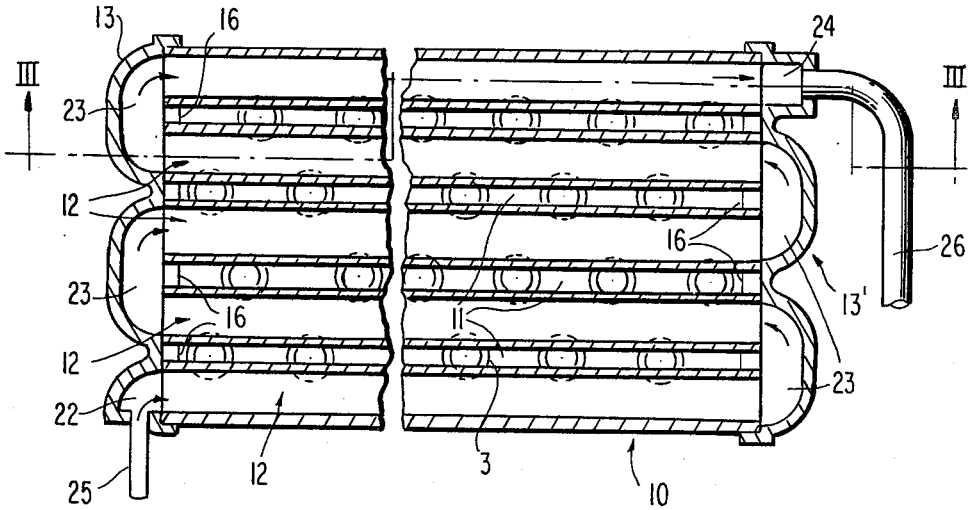
FIG. 4 is a cross-sectional view through the upper connection box of the heat-exchanger according to FIG. 1, taken along line IV—IV thereof.

The heat pipe hollow spaces must be sealed off hermetically against the outside and also against the hollow spaces of the heat carrier channels. In order to assure this in a completely satisfactory manner, the end faces of the heat pipe channels 11, respectively, 11' are sealed off in the illustrated embodiment by small covers or caps 16 (FIGS. 2 and 3) which are brazed or welded into the corresponding slot-like channels prior to the brazing of the guide covers onto the extruded profile. Appropriate therefor above all is a welding-in or such a brazing-in which makes necessary a distinctly higher brazing temperature than is required for the brazing-on of the guide covers. It is to be assured thereby that the connection of the covers 16 will not be impaired by the brazing-on of the guide covers 13, 13' respectively, 14, 14'. After the installation and sealing-off of the covers 16, the end face of the extruded profile is appropriately machined, respectively, finished in a clean and plane manner. Under certain circumstances, a separate sealing-off of the slot-like heat pipe channels 11 and 11' at the end faces can be dispensed with, especially if corresponding longitudinal plugs are formed integral with the guide covers which project ino the end face ends of the heat pipe channels and if additionally it can be assured during the brazing-on of the guide covers that a sufficient amount of solder also reaches the gap of these plugs and a reliable sealing of the heat-pipe hollow spaces with respect to the hollow spaces of the heat carrier channels can be assured.

In the illustrated embodiment, the pipe rows 4 extend transversely to the air stream which is appropriate for a uniform application of the entire air flow cross section with heat because all pipes of a pipe row communicate with each other. It would also be feasible, as such, to arrange the pipe rows parallel to the air stream; however, in that case the temperature gradient between the first pipe of the pipe row and the inflowing air would be different than with pipes lying further to the rear in a pipe row. As a result thereof, the heat transfer would become poorer with the further rearward pipes and the transferable heat capacity would be impaired.

In the illustrated embodiment, the different pipe rows, respectively, the heat-pipe hollow spaces thereof, are separated from one another from a flow point of view. This offers the advantage that with the filling of the individual pipe rows, respectively different parameters for the filling can be provided and thus respectively different temperature levels can be provided in the individual pipe rows during the evaporation, respectively, condensation so that the temperature difference between the pipes and the air which increases toward the rear, can be compensated thereby. Approximately equal heat outputs can then be transferred to the air in all pipe rows which is favorable for the power optimization of the heat-exchanger.

In order to be able to fasten the individual pipes at the connection boxes and to coordinate the same to the heat pipe channels in a mechanically safe and reliably tight manner, a bead 15 extending along the pipe row is formed integral at the outside of the extruded profile which faces the pipe bundle; the bead 15 is dimensioned in its width larger than the pipe outer diameter. At the fastening location of each pipe, the bead 15 is bored through up to the heat pipe channel 11, respectively, 11', and the corresponding pipe end is then sealingly brazed into these bores. The individual brazing operation of the different pipes of the bundle can be undertaken in common in a brazing furnace together with the brazing of the guide covers.

For purposes of improving the heat transfer from the heat carrier medium which flows in the heat carrier channels 12, respectively, 12', to the heat pipe channels 11, respectively, 11' and for purposes of increasing the stability of the extruded profile, continuous cross webs 20, respectively, 20' are arranged in the heat carrier channels 12 and 12'. More particularly, during heating, the heat-pipe hollow spaces may be under a high excess pressure so that the walls of the heat pipe channels 11 are exposed to strong mechanical stresses. The cross webs 20 and 20' reinforce the walls which form the slot-like heat-pipe channel so that these walls are able to withstand high pressure loads notwithstanding slight wall thickness. A corresponding cross reinforcement on the inside of the heat pipe channel 11, respectively 11', itself is unacceptable because the heat pipe channel must be traversable vertically over its entire height extent without impairment or obstruction in order not to impair a heat-exchange and a condensate return flow. Owing to the reinforcing effect of the cross webs, the wall thicknesses not only can be reduced and correspondingly weight and costs can be economized, but by reason of the slight wall thicknesses also the heat transfer is improved.

However, the cross webs 20 and 20' still offer further advantages. On the one hand, they act like heat-exchanger ribs which also favor the heat transfer. On the other hand, by reason of the continuous cross webs, the heat carrier channels 12 are subdivided into several smaller parallelly extending individual channels 21 and 21' which has the advantage at least with the upper connection box 5 traversed by the cooling medium to be evaporated that the two-phase mixture of liquid cooling medium and cooling medium vapor which flows therethrough, exhibits a uniform flow and no stagnating pockets of cooling medium liquid and flow short-circuits of cooling medium vapor can form. For this purpose, partitioning webs 23 are arranged in the individual deflection channels at least in the guide covers 13 and 13' of the upper connection box 5, which correspond to the position of the individual cross webs 20 and which are brazed sealingly to the end faces of the cross webs. As a result thereof, each individual channel 21 of the first heat carrier channel is connected only with the corresponding individual channel of the second heat carrier channel and the latter again with the corresponding individual channel of the next heat carrier channel and so on. In the illustrated embodiment, three separate, parallelly extending meander-shaped courses of channels disposed one above the other result therefrom which are connected with each other exclusively at the beginning in the distribution chamber 22 and at the end in the collecting chamber 24 and which pass over thereat into the corresponding connecting lines 25, 26. The liquid cooling medium which is injected through the narrow injection line 25 distributes itself inside of the distribution chamber 22 uniformly into the three individual channels 21 disposed one above the other by reason of the still liquid condition in that place. Only in the course of the meander-shaped individual channel an increasing evaporation of the cooling medium will take place which will lead to an increasing vapor component in the flow of the two-phase mixture. The subdivision of the heat carrier channels into relatively small individual channels assures that all wall portions of the heat pipe channels are acted upon uniformly. The cooling medium finally passes over completely into the gaseous phase in the individual channels of the heat carrier channel which is traversed last; the gas is sucked-off in common out of all three individual channels by way of the collecting chamber 24 and the suction line 26 connected thereto.

The covers 14 and 14' in the lower connection box 6 are constructed completely differently than the covers in the upper construction box 5. Also, the extruded profile 10' of the lower connection box 6 has a finer subdivision of the heat carrier channels 12' which are traversed by the heating water. This more fine subdivision is chosen in the illustrated embodiment for achieving a corresponding heat transfer factor in order to be able to transfer a predetermined heat quantity with a predetermined structural volume. An even number of individual channels 21' is formed by the cross webs 20'. Apart from the horizontal flat position of the connection box, the individual channels are traversed groupwise from the bottom in the upward direction, i.e., opposite the gravitational force in order to avoid the formation of air pockets with a stagnating or slowly flowing feed. In the embodiment illustrated in FIGS. 1 and 2, the lower three individual channels of all heat carrier channels 12' are traversed in unison in one direction (in FIG. 2, toward the right). The right guide cover 14' is constructed in the manner of a half-pipe shell and deflects the heat carrier medium over the entire width into the three upper individual channels where it flows back to the left guide cover 14. The feed and discharge is connected to this left guide cover 14.

Figure 5:
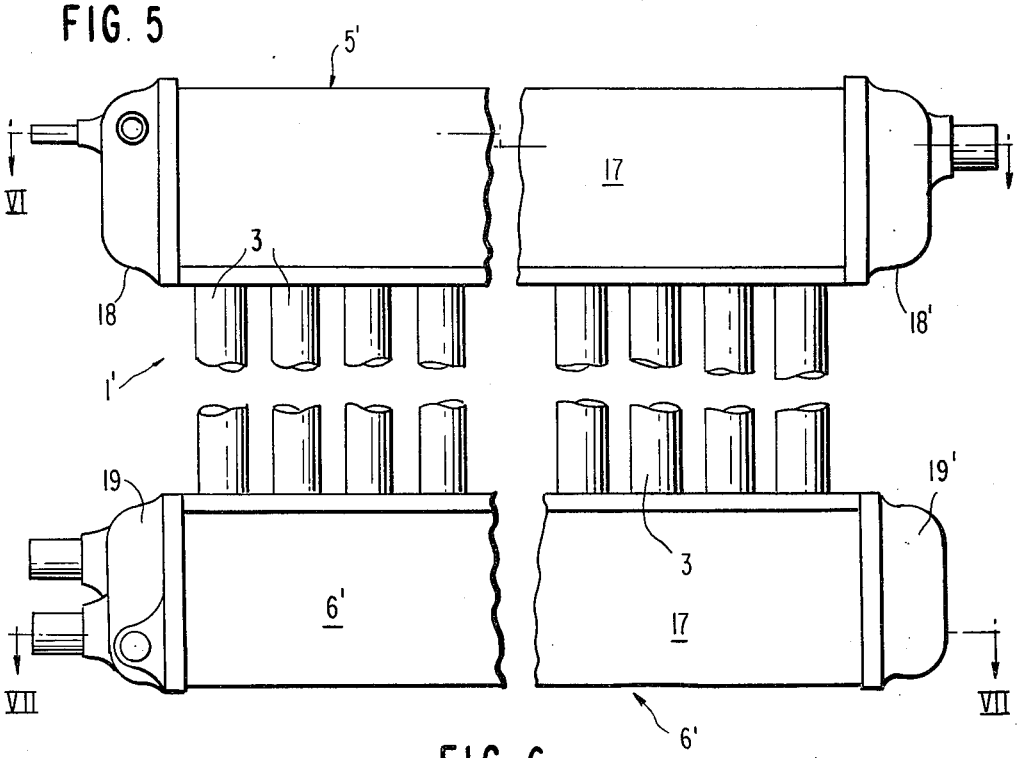
FIG. 5 is an elevational view, in the direction of the air stream, of a further embodiment of a heat-exchanger in accordance with the present invention provided with connection boxes adapted to be acted upon sectionwise.
Figure 6:
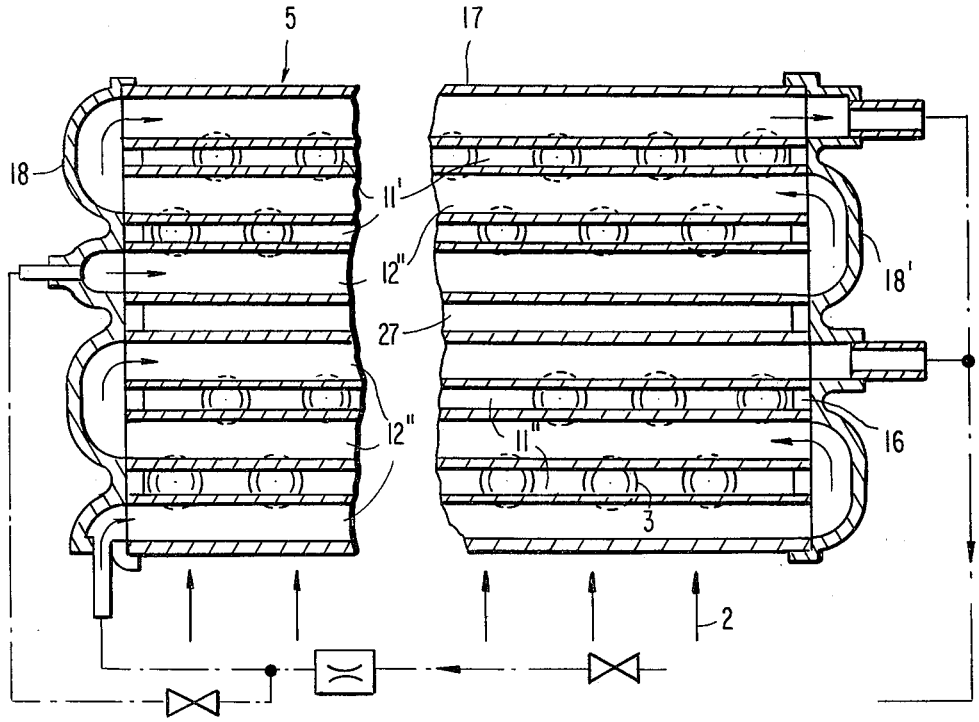
FIG. 6 is a horizontal cross-sectional view through the upper connection box of the heat-exchanger according to FIG. 5, taken along line VI—VI thereof.
Figure 7:
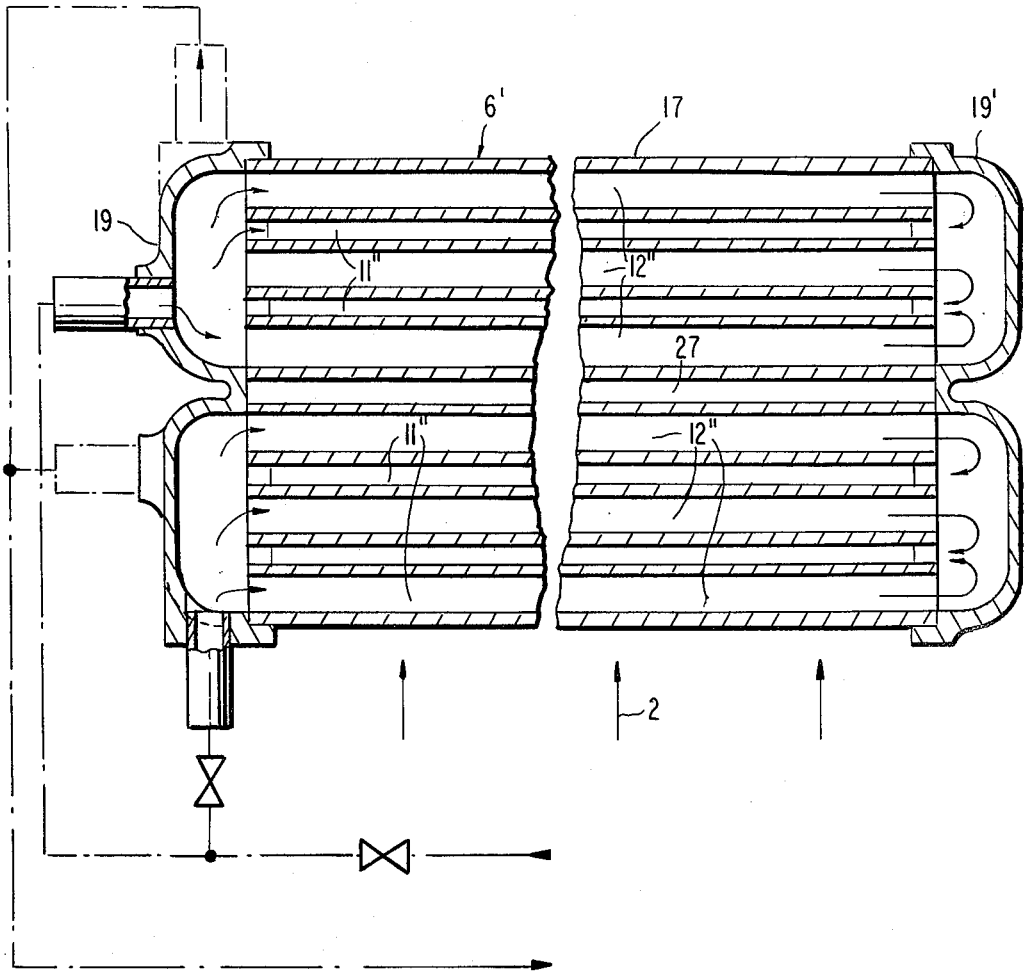
FIG. 7 is a cross-sectional view through the lower connection box of the heat-exchanger according to FIG. 5, taken along line VI—VI thereof.

The further embodiment of a heat-exchanger generally designated by reference numeral 1' which is illustrated in FIGS. 5 to 7, includes two similar connection boxes generally designated by reference numerals 5' and 6' which are formed in this embodiment by identical extruded profiles 17. The peculiarity of this heat-exchanger resides in the construction of the guide covers 18, 18', respectively 19, 19'. More particularly, the guide covers of both connection boxes 5' and 6' are subdivided transversely to the direction of the pipe rows, respectively, transversely to the direction of the air stream into two mutually separate sections provided each with separate feed and discharge connections leading to the outside. As a result thereof, individual ones of the sections can be turned off so that only one of the sections and, accordingly, the associated part of the connection box can be acted upon by itself isolated from the other section. Such a construction of the heat-exchanger, respectively, of the connection boxes, is purposeful for the drying of humid air. In that case, the two first pipe rows disposed in the air stream, are cooled in that cooling medium is fed to the upper connection box 5' whereby the rear section of the guide cover 18 is turned off, i.e., closed off, and the two rear pipe rows are therefore not cooled. At the same time, however, the lower connection box is acted upon with heating water whereby, in that case, the forward section of the guide cover is rendered inoperative or turned off and only the rear pipe rows are heated. The humidity can be removed from the air fed through the heat-exchanger by such an operation in that the air is condensed at the foward cold pipes 3; subsequently, the cooled-off air is again heated to the normal temperature in the rear pipe rows so that the dried air retains normal room temperature.

In order not to experience any heat losses inside of the connection boxes to the turned-off sections of the connection box, an insulating slot 27 (FIGS. 6 and 7) is provided in the illustrated embodiment within the extruded profile which contains exclusively air or vacuum and in which no cross-webs are provided because the latter would represent only heat bridges. For example, with a turned-off rear section, the forward heat carrier channels 12'' are cooled in the upper connection box 5' whereas the corresponding heat carrier channels of the rear section are hot by way of the pipes 3 of the rear pipe rows and by way of the heat pipe channels 11'' coordinated thereto because the lower connection box is heated in the rear section. As mentioned above, a heat-exchange between the differently heated sections of a connection box is to be kept as low as possible by the interposed insulating slot 27.

While we have shown and described only two embodiments in accordance with the present invention, it is understood that the same is not limited thereto but is susceptible of numerous changes and modifications as known to those skilled in the art, and we therefore do not wish to be limited to the details shown and described herein, but intend to cover all such changes and modifications as are encompassed by the scope of the appended claims.

We claim:

1. A heat-exchanger comprising a bundle of substantially parallelly extending metal pipe means adapted to be acted upon by air, which are arranged in at least one row, said pipe means being hermetically sealed and constructed in the manner of heat-pipe means forming heat-pipe hollow spaces, at least one metallic connection box means extending transversely to the pipe bundle and surrounding section-wise the heat-pipe hollow spaces of the pipe bundle, said connection box means being adapted to be traversed by a heat carrier medium and being sealed off with respect to the heat pipe hollow spaces of the pipe bundle but being in heat-transferring connection with said heat pipe hollow spaces, characterized in that (a) the connection box means is formed essentially of an extruded profile means whose profile direction is disposed substantially parallel to the at least one pipe row;

(b) a longitudinally extending slot-like heat pipe channel means being provided in the extruded profile means within the area of each pipe row, said slot-like heat pipe channel means being closed over the entire circumference and at the end faces thereof and being open exclusively toward the individual pipe means of the corresponding pipe row;

(c) longitudinally extending heat carrier channel means open at the end faces of the extruded profile means being provided inside of the extruded profile means on both sides of each heat pipe channel means; and (d) guide cover means sealingly secured at both end faces of the extruded profile means which operatively connect adjacent heat carrier channel means into a channel system adapted to be traversed uniformly by a respective medium.

2. A heat-exchanger according to claim 1, characterized in that distribution and collecting channel means are provided in said guide cover means.

3. A heat-exchanger according to claim 1 or 2, characterized in that U-shaped deflection channel means are provided in the guide cover means.

4. A heat-exchanger according to claim 1, characterized in that the guide cover means connect adjacent heat carrier channel means into a uniform channel system.

5. A heat-exchanger according to claim 1, characterized in that the heat pipe hollow spaces between two adjacent pipe rows respectively heat pipe channel means are completely separated from one another form a flow point of view.

6. A heat-exchanger according to claim 5, characterized in that the pipe rows are disposed substantially transversely to the air stream.

7. A heat-exchanger according to claim 6, characterized in that a bead means which is broader than the pipe outside diameter is formed-on at the extruded profile means on the outside thereof facing the pipe bundle along the course of the pipe rows, said bead means being provided with a bore at the fastening location of each pipe means, said bore extending up to the heat pipe channel means, and the respective pipe end being sealingly secured in a corresponding bore.

8. A heat-exchanger according to claim 7, characterized in that the end faces of the heat pipe channel means are closed off with respect to the guide cover means by separate cover elements.

9. A heat-exchanger according to claim 8, characterized in that the guide cover means are brazed onto the extruded profile means.

10. A heat-exchanger according to claim 7, characterized in that continuous cross web means are provided in the heat carrier channel means, the heat carrier channel means being subdivided by said cross web means into several smaller parallelly extending individual channels.

11. A heat-exchanger according to claim 7, characterized in that one of the guide cover means includes on the inlet side a distribution space branching off exclusively into few individual channels, the remaining individual channels of the connection box means being operatively connected by separate U-shaped deflection channel means meander-shaped into a continuous channel system, the deflection channel means being so constructed and arranged in the guide cover means that the individual channels acted upon on the inlet side are separated from each other over the entire course thereof inside of the connection box means and that the individual channels combine only on the outlet side thereof into a collecting space.

12. A heat-exchanger according to claim 11, characterized in that one connection box means each is provided at the two ends of the pipe bundle, one of said connection box means being adapted to be acted upon by a heat carrier medium warmer than the space temperature while the other is adapted to be acted upon with a heat carrier medium tempered colder than the dew point temperature of the surrounding air, and in that the guide cover means of both connection box means are subdivided transversely to the direction of the pipe rows into the two independent sections, each provided with separate feed and discharge connections leading to the outside, in such a manner that only a portion of the pipe rows of the pipe bundle is adapted to be acted upon by itself from one of the connection box means isolated from the other pipe rows.

13. A heat-exchanger according to claim 12, characterized in that said sections are of substantially the same size.

14. A heat-exchanger according to claim 1, characterized in that a bead means which is broader than the pipe outside diameter is formed-on at the extruded profile means on the outside thereof facing the pipe bundle along the course of the pipe rows, said bead means being provided with a bore at the fastening location of each pipe, said bore extending up to the heat pipe channel means, and the respective pipe end being sealingly secured in a corresponding bore.

15. A heat-exchanger according to claim 1, characterized in that the end faces of the heat pipe channel means are closed off with respect to the guide cover means by separate cover elements.

16. A heat-exchanger according to claim 1, characterized in that the guide cover means are brazed onto the extruded profile means.

17. A heat-exchanger according to claim 1, characterized in that continuous cross web means are provided in the heat carrier channel means, the heat carrier channel means being subdivided by said cross web means into several smaller parallelly extending individual elements.

18. A heat-exchanger according to claim 1 or 17, characterized in that one of the guide cover means includes on the inlet side a distribution space branching off exclusively into few individual channels, the remaining individual channels of the connection box means being operatively connected by separate U-shaped deflection channel means meander-shaped into a continuous channel system, the deflection channel means being so constructed and arranged in the guide cover means that the individual channels acted upon on the inlet side are separated from each other over the entire course thereof inside of the connection box means and that the individual channels combine only on the outlet side thereof into a collecting space.

19. A heat-exchanger according to claim 18, characterized in that continuous cross web means are provided in the heat carrier channel means, the heat carrier channel means being subdivided by said cross web means into several smaller parallelly extending individual channels.

20. A heat-exchanger according to claim 1, characterized in that one connection box means each is provided at the two ends of the pipe bundle, one of said connection box means being adapted to be acted upon by a heat carrier medium warmer than the space temperature while the other is adapted to be acted upon with a heat carrier medium tempered colder than the dew point temperature of the surrounding air, and in that the guide cover means of both connection box means are subdivided transversely to the direction of the pipe rows into the two independent sections, each provided with separate feed and discharge connections leading to the outside, in such a manner that only a portion of the pipe rows of the pipe bundle is adapted to be acted upon by itself from one of the connection box means isolated from the other pipe rows.

* * * * *